United States Patent [19]

Bloom

[11] 3,942,302

[45] Mar. 9, 1976

[54] END CLOSING MACHINE FOR ROLL WRAPPED PACKAGES

[76] Inventor: Max M. Bloom, 1412 Lawndale St., Oshkosh, Wis. 54901

[22] Filed: Aug. 2, 1974

[21] Appl. No.: 494,026

[52] U.S. Cl. ..... 53/138 R; 53/76; 53/179; 29/243.57

[51] Int. Cl.[2] ..... B65B 51/04; B65B 51/08

[58] Field of Search..... 53/138 R, 138 A, 378, 370, 53/180 R, 181, 182 R, 217, 226, 227, 76, 179; 29/243.5, 243.56, 243.57, 33 E

[56] References Cited

UNITED STATES PATENTS

| | | | |
|---|---|---|---|
| 2,792,679 | 5/1957 | Maickel | 53/138 A X |
| 2,886,816 | 5/1959 | Hill | 29/243.57 X |
| 3,267,640 | 8/1966 | Romney et al. | 53/138 R X |
| 3,367,087 | 2/1968 | Järund | 53/138 R X |
| 3,377,692 | 4/1968 | Tipper | 29/243.57 |
| 3,380,226 | 4/1968 | Tracy | 53/138 A |
| 3,389,533 | 6/1968 | Tipper et al. | 53/138 A X |
| 3,513,622 | 5/1970 | Timmerbeil | 53/76 X |

*Primary Examiner*—Travis S. McGehee
*Assistant Examiner*—Horace M. Culver
*Attorney, Agent, or Firm*—Ronald E. Barry

[57] ABSTRACT

An end gathering machine for gathering the loose ends of flexible wrapping material at the end of roll wrapped articles, the machine being located between an infeed conveyor and a discharge conveyor which are used to intermittently transport the roll wrapped articles in a timed sequence to the end gathering machine, the articles being initially aligned with the lead end positioned in the machine and subsequently aligned with the trailing end positioned within the machine. The machine includes first and second sets of upper and lower slides which are movable simultaneously toward and away from each other to gather the loose material at the axis of the rolled article and including automatically sequenced clip assemblies for binding the gathered material to seal the article, the slides being adjustable to gather the material at the axis of the article, the system being electrically interconnected to automatically sequence the movement of the wrapped articles from a storage position through the end closing machine to a loading conveyor.

14 Claims, 10 Drawing Figures

END CLOSING MACHINE FOR ROLL WRAPPED PACKAGES

BACKGROUND OF THE INVENTION

Articles wrapped in plastic materials must be sealed to protect the article against dirt and moisture damage. Many types of systems are presently being used some of which are quite costly, such as heat sealing machines and some of which are inadequate to provide a positive seal, such as hand twisted wire ties. Articles of the type contemplated herein consist of rolled carpets of various diameters which are wrapped in plastic material to form a sleeve or tube. The loose ends extend outwardly from each end of the roll wrapped article and must be gathered preparatory to binding by tightly wrapping a clip or staple around the gathered material. It is important in achieving a tightly wrapped and sealed package to gather the material at the axis of the rolled material.

SUMMARY OF THE INVENTION

The end closing machine of the present invention provides for the automatic gathering of the loose materials at the end of the roll wrapped material. The gathered material is then automatically sealed by applying a clip or staple to the gathered material. The machine is selectively adjustable to vary the location of the axis of the gathered material so that it corresponds to the axis of the roll wrapped article. The end gathering machine is combined with an electrically controlled conveyor system so that it is fully automatic. Prewrapped articles are fed intermittently to the end gathering machine and are continuously sequenced to gather the material at the lead end and the trailing end independently. The ability to perform the end gathering function at each end of the roll independently provides for fast operation of the system.

DRAWINGS

DESCRIPTION OF THE INVENTION

Figure 1:
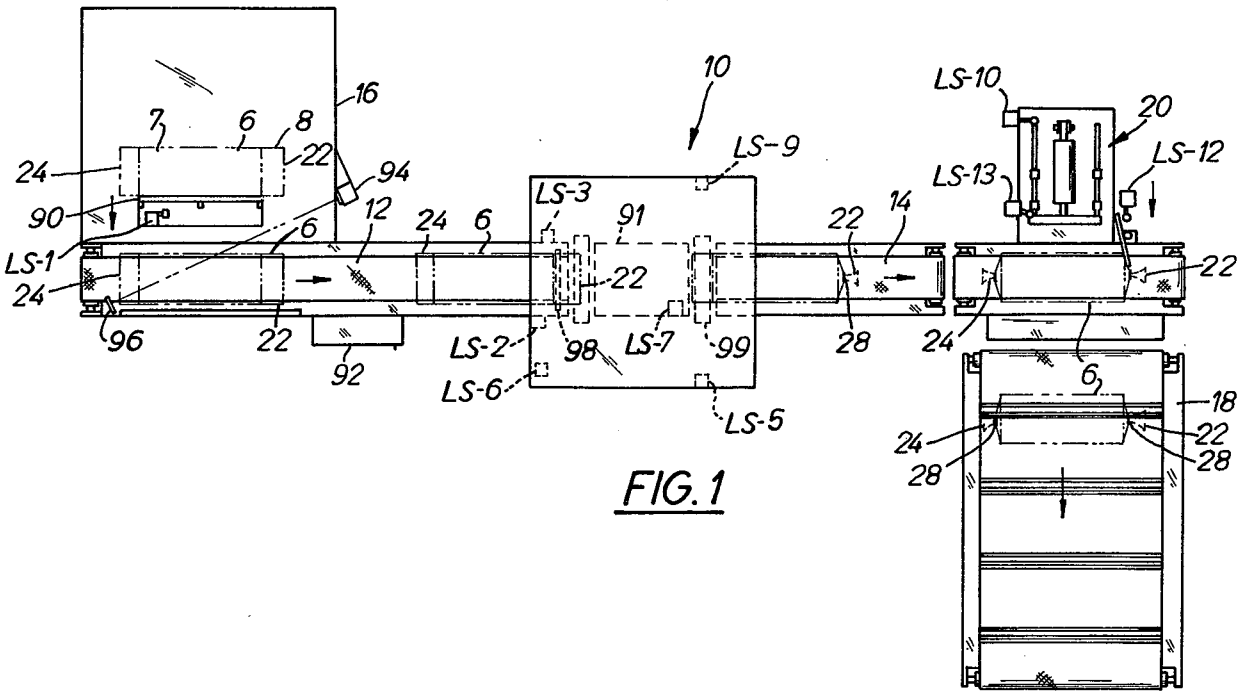
FIG. 1 is a schematic plan view of the wrapping system showing the location of the end closing machine.

The present invention generally relates to an end closing machine 10 for gathering the flexible wrapping material that extends outwardly from the ends of roll 6 wrapped in a flexible material 8. Generally, the rolls 6 are wrapped in plastic sleeves or tubes which must be sealed at the ends to protect the wrapped roll from moisture or dust. In order to achieve a tight wrap at the ends, it is essential that the material be gathered at the axis of the roll. The end closing machine 10 of the present invention provides a means for achieving this result.

In this regard, the end closing machine 10 forms a part of a wrapping system which includes an infeed conveyor 12 located on one side of the machine 10 and a discharge conveyor 14 located on the discharge side of the machine 10. The prewrapped rolls 6 are intermittently fed from a storage table 16 onto the infeed conveyor 12. The sealed rolls 6 are ejected from the discharge conveyor 14 onto a loading conveyor 18 by means of an eject assembly 20.

The rolls 6 which are to be sealed in the plastic tubes or sleeves 8 by the machine 10 of the present invention, are rolled articles such as carpets or the like. The rolls 6 are initially rolled or wrapped in the flexible wrapping material 8 to form a sleeve or tube. More specifically, the wrapping material is in the form of a plastic material such as polyvinyl chloride. The sleeves or tubes of wrapping material extend outwardly from the ends with the loose ends 22 and 24 of the wrapping material extending axially outwardly from the ends of the roll 6. The wrapped rolls 6 are fed intermittently in a timed sequence as described hereinafter from the storage table 16 to the infeed conveyor 12 which carries the wrapped roll 6 to the inlet side of the end closing machine 10. The lead end 22 and trailing end 24 of wrapping material on the wrapped roll 6 are gathered together for binding by the end closing machine 10.

Means in the form of a Tipper Tie clipper 26 is used to apply a clip or staple 28 to the lead end 22 which has been gathered together by the end closing machine 10 to seal the lead end 22. The partially sealed roll 6 is then transported through the end closing machine 10 to the discharge conveyor 14 and stopped with the trailing end 24 of the wrapped roll 6 aligned with the discharge side of the end closing machine 10.

Means in the form of a second Tipper Tie clipper 26 is used to apply a second clip or staple 28 to the trailing end 24 of the wrapped roll 6. The roll 6 is then sealed within the wrapping material 8 and is transported by the discharge conveyor 14 to a position adjacent the load conveyor 18. The finally wrapped roll 6 is then ejected by means of the eject assembly 20 onto the loading conveyor 18.

THE END CLOSING MACHINE (FIGS. 3 THROUGH 5)

In accordance with the present invention, the end closing machine 10 includes a frame 30 which is positioned between the discharge end of the infeed conveyor 12 and the inlet end of the discharge conveyor 14. The lead end 22 of the wrapped roll 6 is gathered together by means of an upper slide 32 and a lower slide 34 supported for vertical motion on the inlet side of the frame 30. The trailing end 24 of the wrapping material is gathered together by means of an upper slide 36 and a lower slide 38 supported for vertical motion on the discharge side of the frame 30. Each of the upper slides 32 and 36 includes a set of plates *a*, *b* and *c* secured together in a spaced parallel relation by transverse side plates 40. The plate a includes a "V" shaped notch 44 and is supported in a parallel relation to plates *b* and *c* and is movable into a space between corresponding plates *x* and *y* on the lower slide as described hereinafter. The plates *b* and *c* are spaced from the plate a a distance sufficient to accommodate one of the Tipper Tie clippers 26 and cooperate with a corresponding plate *z* on the lower slide as described hereinafter. The upper slide 32 is arranged with the plate a located at the discharge end of the conveyor 12. The upper slide 36 is identical to the slide 32 but is turned 180° with respect to the upper slide 32 and is located with the plate a adjacent to the inlet end of the discharge conveyor 14.

Each of the lower slides 34 and 38 includes a set of plates *x*, *y* and *z* each of which includes a "V" notch 46. The plates *x*, *y* and *z* are supported in a spaced parallel relation by side plates 48. The plates on the upper slide 32 are spaced so that plate a will move into the space between the plates *x* and *y* on the lower slide 34 and the plates *b* and *c* on upper slide 32 are spaced to receive the plate *z* on the lower slide 34. The lower slide 34 is located at the discharge end of the infeed conveyor 12. The lower slide 38 is identical to slide 34 but is turned 180° with respect to the lower slide 34 and is located at the inlet end of discharge conveyor 14.

Figure 8:
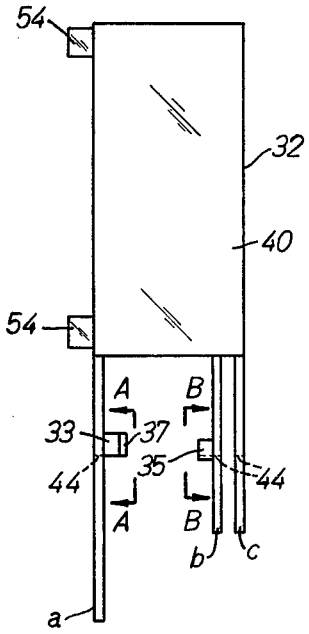
FIG. 8 is an enlarged side view of the upper slide.
Figure 8A:
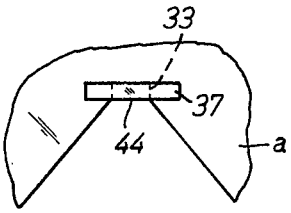
FIG. 8A is a view taken on line A—A of FIG. 8.
Figure 8B:
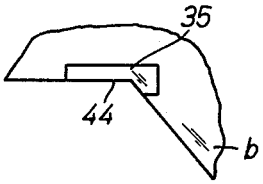
FIG. 8B is a view taken on line B—B of FIG. 8.

Means are provided on the upper slides 32 and 36 for aligning the wrapping material into the notch 46 in the lower slides 34 and 38. Such means, as seen in FIGS. 8, 8A and 8B, is in the form of a pair of steel blocks 33 and 35 secured to plates *a* and *b*, respectively. The block 33 is located at the apex of notch 44 and includes a cross bar 37. The block 35 is mounted on plate b at the apex of the notch 44. The blocks 33 and 35 force the gathered material into the notch 44 of the Tipper Tie clipper to assure that the gathered wrapping material is in a proper position for the clip as described hereinafter.

Each of the upper slides 32, 36 and lower slides 34, 38 are supported for vertical motion on Thompson shafts 52 by means of ball bushings 54 provided on the sides of the slides. The upper slides are suspended from chain beams 66 by means of a selectively adjustable mechanism 72. The slides are moved simultaneously toward and away from each other on the shafts 52 by means of a pneumatic actuated assembly 56, as seen in FIG. 5.

In this regard, the assembly 56 includes a penumatic cylinder 58 which is connected at its upper end to the frame 30 and a piston rod 60 which is connected to the lower slide 34. A pair of chains 62 and 64 are connected to each side of the slides to provide equal but opposite motion to the upper and lower slides 32 and 34. The slides 36 and 38 are moved in the same manner by an assembly identical to assembly 56.

Figure 5:
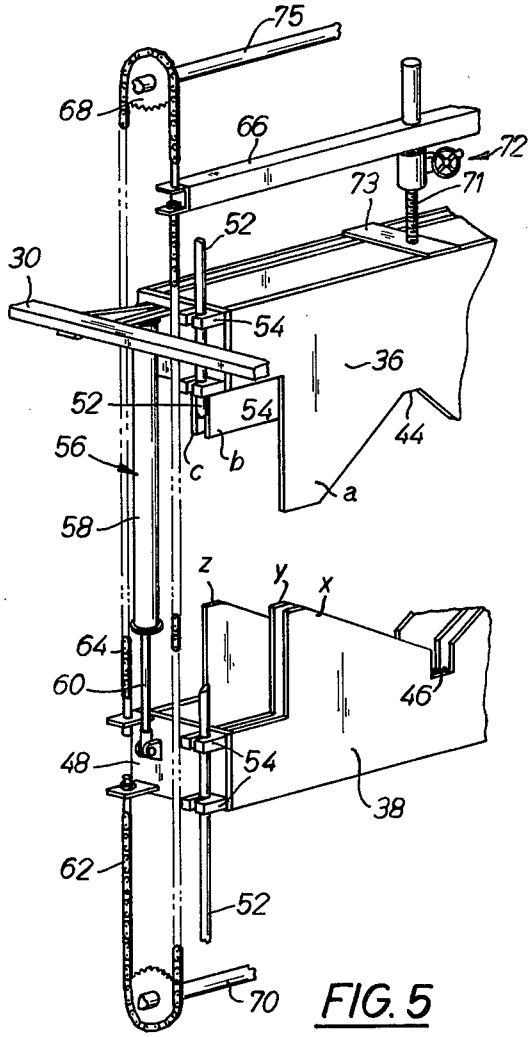
FIG. 5 is a schematic view of the chain drive assembly for the slides.
Figure 3:
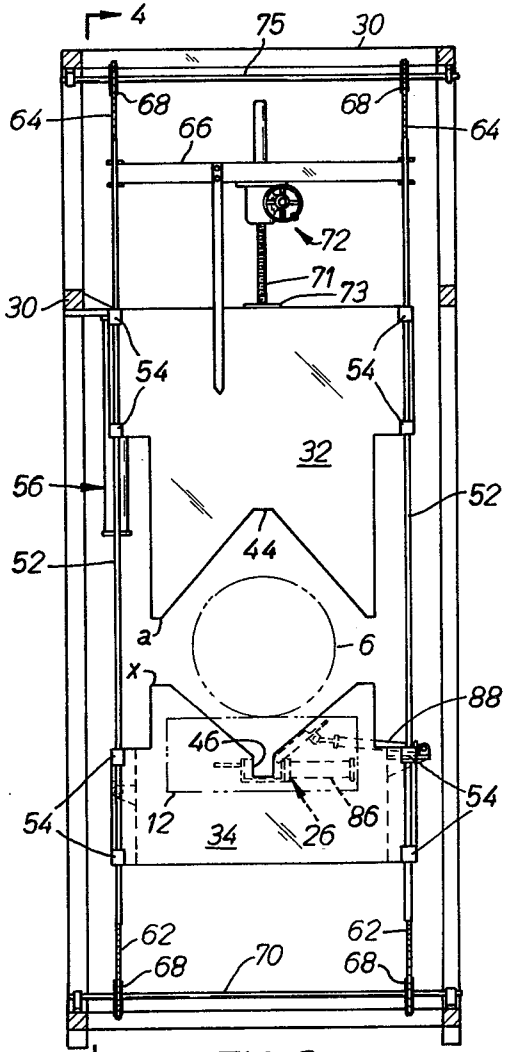
FIG. 3 is an elevation view of the inlet side of the end closing machine taken on line 3—3 of FIG. 4.
Figure 4:
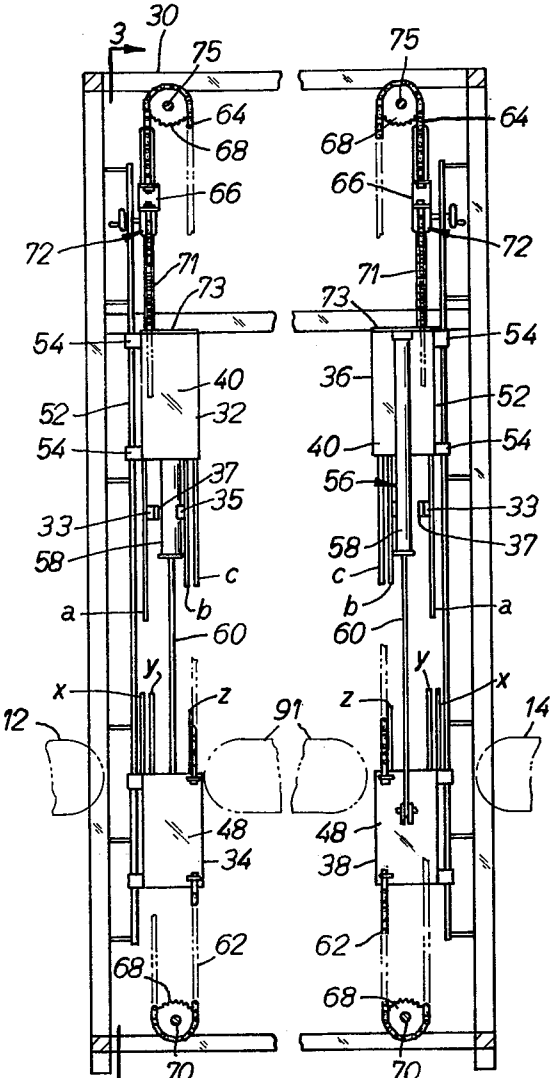
FIG. 4 is a side elevation view of the end closing machine taken on line 4—4 of FIG. 3.

Referring to FIG. 5, one of the chains 62 is shown connected to the bottom of the lower slide 34 and to the bottom of the chain beam 66. The chain 62 is wrapped around a sprocket 68 on the end of an equalizer shaft 70. The second chain 64 is connected to the top of the lower slide 34 and to the top of the chain beam 66. The chain 64 is wrapped around a sprocket 68 on the end of an equalizer shaft 75. Each of the equalizer shafts 70 and 75 are provided with similar sprockets at the opposite ends for the chains on the opposite sides of the slides.

Whenever the pneumatic assembly 56 is actuated to raise the lower slide 34 or 38, the upward motion of the lower slides will lower the chain beam 66 toward the lower slides. The plate a on the upper slide will move into the space between plates *x* and *y* on the lower slide. The plate *z* on the lower slide will move into the space between plates *b* and *c* on the upper slide. Any material located between the slides will be forced by the sides of notches 44 and 46 toward the axis of the wrapped rolls.

The flexible material should be gathered at the axis of the roll 6 in order to provide a tight compact roll. This is accomplished by means of the adjustable mechanism 72. This mechanism 72 includes a screw threaded shaft 71 on the chain beam 66 and a corresponding threaded nut 73 on the top of the upper slide 32. The upper slide 32 can be adjusted with respect to the chain beam to align the apex of the notch 44 with the axis of the roll 6.

A transfer conveyor 91 is provided in the end closing machine 10 between the first set of slides 32 and 34 and the second set of slides 36 and 38. The transfer conveyor 91, as well as the infeed conveyor 12, discharge conveyor 14 and loading conveyor 18, are all conventional belt type conveyors with separate drive motors. The drive motors are energized off of switches as described hereinafter.

THE TIPPER TIE CLIPPER

The material gathered at the ends of the wrapped rolls 6 is bound by means of the Tipper Tie clippers 26 provided in the lower slides 34 and 38. A Tipper Tie clipper is a conventional type of device for applying clips to the ends of a wrapped package.

Figure 6:
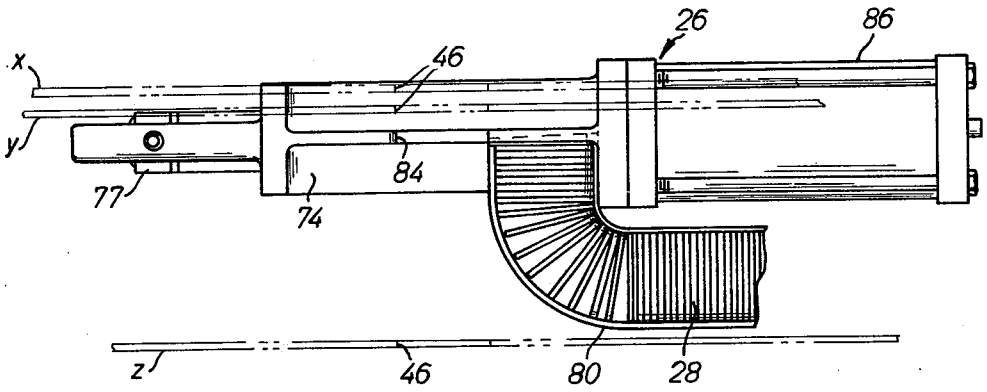
FIG. 6 is a top view of the Tipper Tie clipper.
Figure 7:
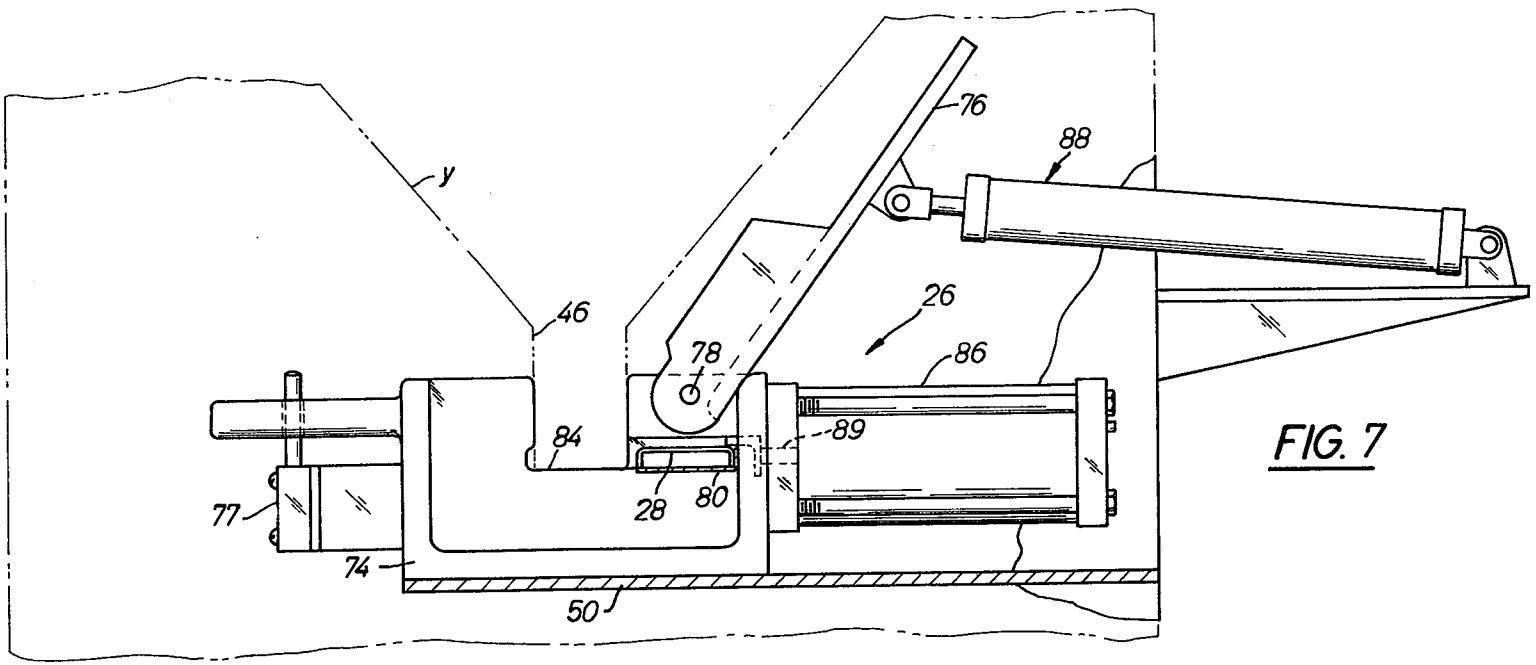
FIG. 7 is a side view of the Tipper Tie clipper.

Generally, the Tipper Tie clippers are identical and the following description relates to the Tipper Tie clipper 26 in the lower slide 34. This clipper, as seen in FIGS. 6 and 7, includes a base 74 which is mounted on the brace plate 50 which is mounted between plates y and z of the lower slide 34. A pivot arm or handle 76 is pivotally secured to the base 74 by a pin 78. A clip storage or feed rack 80 is provided along one side of the base 74 and holds a plurality of clips 28 in a position to be fed into the base 74. The base 74 is provided with a notch 84 into which the gathered material at the ends of the wrapped articles is forced by the slides 32 and 34. The handle 76 is then pivoted to bind a clip 28 around the gathered material.

More particularly, the base 74 as seen in FIG. 7 includes a square shaped notch 84. A pneumatic cylinder 86 is mounted on one end of the base with the piston rod 89 positioned to align the clip 28 with the notch 84. In this regard, when handle 76 is closed over opening 84 by cylinder 88, the handle 76 will depress a pushbutton switch 77 to actuate cylinder 86. The handle 76 includes a bending die which is aligned with clip 28 in the closed position. The piston rod 89 of the cylinder 86 will push clip 28 through the die to encircle the material gathered between the slides.

The Tipper Tie clippers 26 are aligned in the lower slide 34 between the plates *y* and *z*. The notch 84 is aligned with the V-notch 46 provided in the plates *x*, *y* and *z*. When the slides 32 and 34 are closed to gather the material at the ends of the wrapped package, the notches 44 and 46 in the slides 32 and 34 will force the material into the notch 84 in the Tipper Tie clipper. When the slides 32 and 34 reach the closed position, the cylinder assembly 88 is actuated to pivot the handle toward the notch 84 to bend the clip 28 into tight engagement with the gathered material at the end of the roll.

THE SWITCH CIRCUITS

The prewrapped articles which are fed to the storage table 16 automatically sequence from the storage table 16 to the loading conveyor 18 by means of a switch circuit provided throughout the wrapping system. The switch circuit automatically feeds the prewrapped rolls 6 from the storage table 16 to the infeed conveyor 12, stops the infeed conveyor 12 when the lead end 22 of the wrapped roll is aligned with the inlet side of the end closing machine 10. After applying the clip 28 to the gathered material at the lead end 22 of the wrapped roll, the roll is sequenced to the discharge conveyor 14 and stopped with the trailing end 24 aligned with the end closing machine 10. After the material at the trailing end of the roll is gathered and clipped, the roll is moved to the end of the discharge conveyor 14 and ejected onto the loading conveyor 18.

Figure 2:
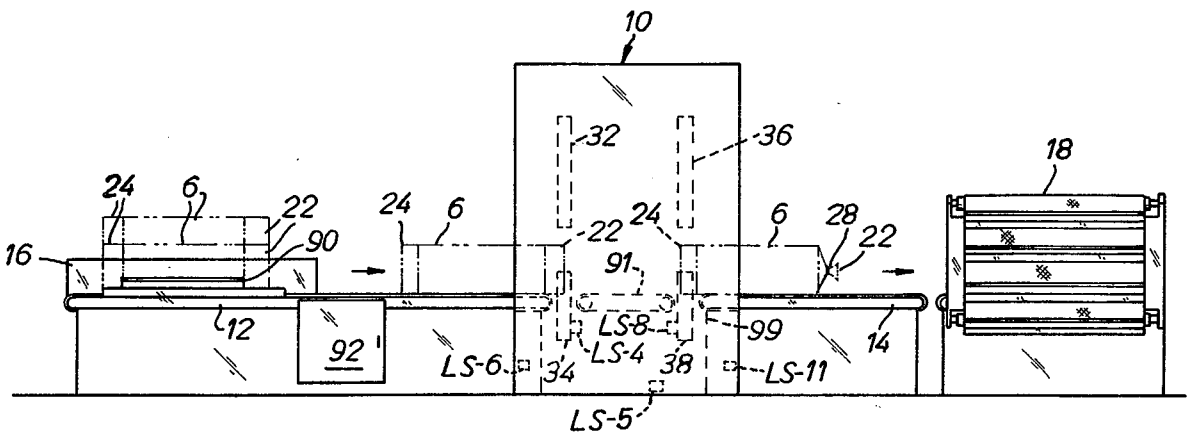
FIG. 2 is a schematic side view of the wrapping system as shown in FIG. 1.

More particularly, the prewrapped rolls 6 are retained on the storage table 16 by means of a stop plate 90 as seen in FIGS. 1 and 2. The wrapping system is started by depressing a manual switch in the control panel 92 which energizes the system. With a roll on the storage table 16 it depresses LS-1 thereby releasing the stop plate 90 allowing a roll 6 to roll onto the infeed conveyor 12. In doing so, the roll 6 will interrupt a beam from photocell 94 across infeed conveyor 12 to reflector 96. The roll 6 is carried along infeed conveyor 12 and the beam will be re-established. A timer in photocell 94 will time out and allow the stop plate 90 to return to a vertical position. With a roll 6 actuating LS-1, the stop plate 90 will be actuated to allow the next roll to roll onto the infeed conveyor.

As the lead end 22 of the roll 6 reaches the end of the infeed conveyor 12, the conveyor 12 will be stopped by means of a second stop plate 98 located at the end of the infeed conveyor 12 in a transverse relation thereto. As the roll 6 depresses the second stop plate 98, switches LS-2 and LS-3 will be tripped. Switch LS-2 actuates a brake to stop the infeed conveyor. Switch LS-3 deenergizes the conveyor drive motor and energizes the end closing machine 10.

Actuation of the end closing machine 10 initiates the movement of the upper slide 32 and lower slide 34 toward each other by pressurizing the pneumatic cylinder assembly 56. It should be noted that the slides 32 and 34 will gather the flexible wrapping material at the axis of the roll 6. When the slides 32 and 34 reach the fully closed position, a switch LS-4 will be closed actuating a timer for the first Tipper Tie clipper 26 to seal the lead end 22 of the roll 6 by applying a clip 28 to the material gathered in the notches of the slide. On completion of the clip applying sequence, the timer for the first Tipper Tie 26 will actuate the pneumatic assembly 56 to return the slides 32 and 34 to their initial position. On return of the lower slide 32 to its initial position, a switch LS-6 is closed to start the infeed conveyor 12 and the transfer conveyor 91.

The infeed conveyor 12 and the transfer conveyor 91 will transport the roll 6 through the end closing machine 10. The lead end of the roll 6 as it passes through the end closing machine 10 will engage a switch plate 99 that actuates a switch LS-7 that starts a timer for the discharge conveyor 14. When the timer times out, the transfer conveyor drive and discharge conveyor drive will be deactivated with the trailing end 24 aligned with the slides 36 and 38. The timer automatically sequences the end closing machine 10 to close the slides 36 and 38. The lower slide 38 actuates a switch LS-8 to actuate a timer for the second Tipper Tie clipper 26. A clip 28 will be attached to the material gathered at the trailing end 24 of the roll 6.

After the timer for the second Tipper Tie clipper has timed out, the discharge conveyor 14 is restarted when the slides 36 and 38 are fully open to trip a switch LS-11. The discharge conveyor 14 will move the roll to the end of the discharge conveyor where a switch LS-12 is tripped to actuate the eject assembly 20. The eject assembly 20 will push the wrapped roll onto the load conveyor. When the eject assembly 20 reaches the end of its stroke, a switch LS-13 will be tripped to start the load conveyor 18 and return the eject assembly to the start position.

OPERATION

The wrapping system as described above is used to gather the ends of prewrapped rolls or articles 6 and to bind the ends with a clip 28 to seal the flexible material at the ends of the rolls. The prewrapped rolls 6 are rolled onto a storage table 16 where they are retained by means of a stop plate 90.

The system is activated by depressing a manual start button on a control panel 92 to activate a switch LS-1 that releases the stop plate allowing the wrapped roll to roll onto the infeed conveyor 12 and start the infeed conveyor 12. As the roll rolls onto the conveyor 12, it will interrupt the beam between the photocell 94 and the reflector 96.

The infeed conveyor will move the roll axially toward the end closing machine 10. As the roll clears the beam between the photocell 94 and reflector 96. A timer in photocell 94 will time out and the switch LS-1 will again be tripped allowing the next roll to roll onto the infeed conveyor.

The timer in the photocell 94 provides time to properly space the rolls on the infeed conveyor 12. When the first roll reaches the end of the conveyor it engages a stop plate 98 actuating switches LS-2 and LS-3. Switch LS-2 will activate a brake to stop the conveyor. Switch LS-3 will set up an open circuit to the conveyor drive and energizes the end closing machine 10 to initiate an end closing operation by the first set of slides 32 and 34.

When the end closing machine completes the end closing operation on the lead end 22 of the wrapped roll, the first set of slides will move to their open positions actuating a switch LS-6 closing the circuit to the infeed conveyor and the transfer conveyor 91. The first roll will be moved through the end closing machine 10 by means of the transfer conveyor 91 and the infeed conveyor will move the second roll toward the end closing machine in the same sequence as described above for the first roll. The lead end of the second roll as it passes through the end closing machine will engage a switch plate 99 that actuates a switch LS-7 to start a timer for the discharge conveyor 14. When the timer times out both the transfer conveyor drive motor and the discharge conveyor drive motor will be deactivated with the trailing end aligned with the second set of slides 36 and 38. The timer automatically sequences the operation of the end closing machine 10 to automatically apply a clip to the material gathered at the trailing end 24 of the wrapped roll.

Upon completion of the operation of the second set of slides, a switch LS-11 is closed to actuate the discharge conveyor. The discharge conveyor will move the roll axially into engagement with a switch LS-12 which deactivates the transfer conveyor drive motor and simultaneously actuates the eject assembly 20. The eject assembly 20 will push the roll onto the load conveyor 18 and on reaching the end of its stroke will actuate a switch LS-13 to start the load conveyor and return the eject assembly 20 to neutral. When the eject assembly 20 reaches the neutral position, a switch LS-10 will be closed setting up an interlock circuit for the discharge conveyor.

I claim:

1. An apparatus for gathering the ends of a wrapping material on a rolled article, said apparatus comprising:
- an infeed conveyor,
- means at the end of the infeed conveyor for gathering the ends of the wrapping material,
- means for binding the gathered end of said material,
- an intermediate conveyor for transporting the wrapped roll to a discharge conveyor,
- means at the inlet end of the discharge conveyor for gathering the loose end of the wrapping material adjacent the inlet end of the discharge conveyor,
- means for binding the gathered ends of said wrapping material,
- and means for ejecting the wrapped material from the discharge conveyor.

2. The apparatus according to claim 1 wherein said gathering means comprises an upper and lower plate each having a V-notch and including means for moving said plates towards and away from each other to gather the loose material in the V of said notches.

3. An end closing machine for gathering the ends of a wrapping at each end of a rolled article, said machine comprising:
- a frame,
- an upper and a lower slide supported in a spaced relation on said frame for movement toward and away from each other, said upper slide including a number of plates mounted in a parallel spaced relation and each plate having an inverted V-shaped notch, said lower slide including a number of plates mounted in a parallel spaced relation and each plate including a V-shaped notch corresponding to the inverted V-shaped notch of the plates on said upper slide,
- two of said plates on said upper slide being arranged to cooperate with a single plate on the lower slide for gathering loose material at the end of the prewrapped roll at the axis of the roll,
- two pairs of stabilizing sprockets mounted on said frame,
- one of said pair being located above the upper slide and the other pair being located below the lower slide,
- a chain beam,
- a first pair of chains having one end connected to the lower slide and wrapped around the upper pair of equalizer sprockets, the other end of the chain being connected to the chain beam,
- a second pair of chains having one end connected to the lower slide wrapped around the lower equalizer sprockets and the other end connected to the chain beam,
- means for connecting the said upper slide to said chain beam,
- a pneumatic piston and cylinder assembly having one end connected to the frame and the other end connected to said lower slide whereby on movement of said lower slide said upper slide will move an equal distance in the opposite direction,
- and means mounted on said lwoer slide for binding the gathered ends of loose material to seal the package.

4. The apparatus according to claim 3 including means on said slides for aligning said gathered material in said binding means.

5. The machine according to claim 3 wherein said chain beam is selectively adjustable to vary the axis of the gathered material in accordance with the diameter of the prewrapped roll.

6. A wrapping system for binding the ends of rolls wrapped in flexible material, said system including:
- an end closing machine,
- an infeed conveyor positioned to carry the rolls axially towards the machine and a discharge conveyor to carry rolls axially away from said machine, the machine including
- a first means for gathering the flexible material at the lead end of the roll when the roll is located at the end of the infeed conveyor and a second means for gathering the flexible material at the trailing end of the roll when the roll is located at the beginning of the discharge conveyor, said first and second means including clip means for attaching a staple to the material gathered at the ends of said roll.

7. The system according to claim 6 including means for adjusting the first and second means to gather the material at the axis of the prewrapped roll.

8. The assembly according to claim 6 wherein said first and second means each include an upper slide and a lower slide, means for moving said slides simultaneously towards and away from each other, each slide including a V-shaped notch whereby material will be gathered at the apex of said notches.

9. The assembly according to claim 8 wherein each of said lower slides includes means for automatically applying a clip to the material gathered in the notches of the slides.

10. An end closing machine for sealing the ends of the flexible material wrapped around a rolled article, said machine comprising a frame,
- means for conveying the wrapped article axially in a step by step manner,
- a first pair of slides mounted on one side of said frame for movement toward and away from each other to gather the flexible material at the axis of the lead end of said article at the end of one step of movement of the conveyor,
- a second pair of slides mounted on the other side of said frame for movement toward and away from each other to gather the flexible material at the axis of the trailing end of said rolled article at the end of the next step of movement of the conveyor,
- and means on one of said slides for securing a clip to the gathered material.

11. The machine according to claim 10 wherein each pair of slides includes an upper slide and a lower slide, each upper slide including a pair of plates having V-notches and being positioned for movement transverse to the ends of said rolled articles and said lower slides including a single plate having a V-notch and being positioned to move transverse to the ends of said rolls in cooperation with said pair of plates on said lower slides.

12. The machine according to claim 10 wherein said machine includes pneumatic piston and cylinder assemblies which move said slides simultaneously toward and away from each other.

13. The machine according to claim 12 wherein said piston and cylinder assemblies include means for adjusting the position of said upper slides to correspond to the axis of said rolled articles.

14. The apparatus according to claim 1 wherein said gathering means includes means for aligning the gathered material in said binding means.

* * * * *